US008783476B2

(12) United States Patent
Woodley et al.

(10) Patent No.: US 8,783,476 B2
(45) Date of Patent: Jul. 22, 2014

(54) CLADDED FIXTURE

(75) Inventors: Brett Woodley, Wilmette, IL (US); Michael Grund, Arlington Heights, IL (US)

(73) Assignee: Opto International, Inc., Wood Dale, IL (US)

( * ) Notice: Subject to any disclaimer, the term of this patent is extended or adjusted under 35 U.S.C. 154(b) by 66 days.

(21) Appl. No.: 13/590,917

(22) Filed: Aug. 21, 2012

(65) Prior Publication Data

US 2014/0054252 A1 Feb. 27, 2014

(51) Int. Cl.

| | |
|---|---|
| ***A47F 5/00*** | (2006.01) |
| ***A47B 43/00*** | (2006.01) |
| ***A47B 47/00*** | (2006.01) |
| ***A47B 57/00*** | (2006.01) |
| ***A47B 95/04*** | (2006.01) |
| ***A47B 13/08*** | (2006.01) |
| *E04F 19/02* | (2006.01) |

(52) U.S. Cl.

CPC ..... *A47B 95/043* (2013.01); *A47B 13/083* (2013.01); *E04F 19/028* (2013.01); *E04F 19/02* (2013.01)

USPC ..... 211/183; 211/191

(58) Field of Classification Search

CPC ..... A47B 95/043; A47B 96/00; A47B 95/00; A47B 96/021; A47B 96/14; A47B 57/402; A47B 13/083; A47B 13/08; B60R 19/44; B60R 19/18; B60R 19/445; B60R 19/023; A47F 5/0853; B25H 3/04; E01F 15/0469; E01F 15/141; E04F 13/06; E04F 19/028; E04F 19/022; E04F 19/02

USPC ..... 211/183, 191, DIG. 1, 175, 189; 52/255; 108/27; 293/142; 248/345.1, 683

See application file for complete search history.

(56) References Cited

U.S. PATENT DOCUMENTS

| | | | | |
|---|---|---|---|---|
| 2,517,284 | A | | 8/1950 | Calvert |
| 2,743,980 | A | | 5/1956 | Hobbs |
| 2,975,908 | A | | 3/1961 | Huet |
| 3,304,108 | A | | 2/1967 | Lay |
| 3,559,356 | A | * | 2/1971 | Koral ..... 52/254 |
| 3,717,968 | A | * | 2/1973 | Olsen et al. ..... 52/288.1 |
| 3,832,957 | A | | 9/1974 | Mendenhall |
| 3,892,189 | A | | 7/1975 | Killam |
| 3,921,539 | A | | 11/1975 | Berger |
| 4,012,878 | A | * | 3/1977 | Ellingson ..... 52/288.1 |
| 4,049,355 | A | | 9/1977 | Kawazu |
| 4,113,110 | A | * | 9/1978 | Mittag ..... 211/191 |
| 4,124,322 | A | | 11/1978 | Parisien |
| 4,132,390 | A | | 1/1979 | Pfarr, Jr. |
| 4,430,833 | A | * | 2/1984 | Balzer et al. ..... 52/255 |
| 4,437,572 | A | | 3/1984 | Hoffman |
| 4,552,271 | A | | 11/1985 | Kranz |
| 4,573,288 | A | | 3/1986 | Adell |
| 4,585,131 | A | * | 4/1986 | Crossman et al. ..... 211/206 |
| 4,606,170 | A | | 8/1986 | Mendenhall |
| 4,709,522 | A | | 12/1987 | Carnahan |

(Continued)

*Primary Examiner* — Jennifer E Novosad

(74) *Attorney, Agent, or Firm* — Husch Blackwell LLP

(57) ABSTRACT

The display fixture system comprises a framework on which a removable cover is secured. Each visible structural member of the framework is covered with a removable cover or cladding in which the vertical members are held in place by the horizontal members. Each vertical and horizontal member is also independently held to the framework by a magnet or other fastener. By virtue of being easily removable, each of the vertical and horizontal members may be decorated according to an easily changeable theme or color.

14 Claims, 8 Drawing Sheets

(56) References Cited

U.S. PATENT DOCUMENTS

| | | | | | |
|---|---|---|---|---|---|
| 4,710,992 | A | * | 12/1987 | Falwell et al. | 5/663 |
| 4,898,285 | A | * | 2/1990 | Field | 211/183 |
| 5,071,281 | A | | 12/1991 | Murphy et al. | |
| 5,313,754 | A | * | 5/1994 | Jensen | 52/255 |
| 5,482,238 | A | * | 1/1996 | Kreiter | 248/222.12 |
| 5,508,078 | A | * | 4/1996 | Stalnaker | 428/71 |
| 5,590,939 | A | * | 1/1997 | Piontek | 312/263 |
| 5,603,140 | A | * | 2/1997 | Pryce | 16/18 CG |
| 5,605,238 | A | | 2/1997 | Jacobs | |
| 5,934,623 | A | * | 8/1999 | Kopish | 248/65 |
| 6,019,336 | A | * | 2/2000 | Havens | 248/345.1 |
| 6,021,908 | A | | 2/2000 | Mathews | |
| 6,044,601 | A | * | 4/2000 | Chmela et al. | 52/287.1 |
| 6,161,488 | A | | 12/2000 | Reddicliffe | |
| D437,723 | S | * | 2/2001 | Lees | D6/610 |
| 6,318,293 | B1 | * | 11/2001 | Cranfill et al. | 119/245 |
| 6,354,049 | B1 | * | 3/2002 | Bennett | 52/287.1 |
| 6,357,609 | B1 | | 3/2002 | Van Noord et al. | |
| 6,585,118 | B2 | | 7/2003 | Kellogg | |
| 6,682,037 | B1 | * | 1/2004 | Ouellette | 248/345.1 |
| 6,786,017 | B2 | | 9/2004 | Thompson | |
| 7,104,525 | B2 | * | 9/2006 | Ricci | 256/65.14 |
| 7,182,993 | B1 | * | 2/2007 | Hamilton | 428/100 |
| 7,258,241 | B2 | * | 8/2007 | Reid | 211/113 |
| D560,819 | S | * | 1/2008 | Thelwell | D25/38.1 |
| 7,784,756 | B1 | * | 8/2010 | Wentworth | 248/222.12 |
| 7,950,706 | B2 | * | 5/2011 | Shaw et al. | 293/142 |
| 8,267,262 | B2 | * | 9/2012 | Thelwell | 211/183 |
| 8,365,928 | B1 | * | 2/2013 | Lauro | 211/183 |
| 8,505,467 | B1 | * | 8/2013 | Roberts et al. | 108/51.11 |
| 2001/0014250 | A1 | | 8/2001 | Plummer et al. | |
| 2001/0047975 | A1 | | 12/2001 | Lazas et al. | |
| 2001/0049909 | A1 | * | 12/2001 | Homolka et al. | 49/460 |
| 2002/0164208 | A1 | | 11/2002 | Koelfner | |
| 2004/0088933 | A1 | * | 5/2004 | Mayes | 52/211 |
| 2004/0094496 | A1 | * | 5/2004 | MacDonald | 211/189 |
| 2004/0149671 | A1 | * | 8/2004 | Krueger et al. | 211/183 |
| 2004/0234333 | A1 | * | 11/2004 | Hinojosa | 404/6 |
| 2006/0054063 | A1 | * | 3/2006 | Ryan, Jr. | 108/27 |
| 2007/0023374 | A1 | * | 2/2007 | Nawrocki | 211/90.01 |
| 2007/0251426 | A1 | | 11/2007 | Li | |
| 2008/0029676 | A1 | * | 2/2008 | Huxtable et al. | 248/345.1 |
| 2008/0149581 | A1 | * | 6/2008 | Clarke et al. | 211/183 |
| 2008/0217505 | A1 | | 9/2008 | Cohoon | |
| 2008/0217506 | A1 | | 9/2008 | Cohoon | |
| 2009/0189045 | A1 | * | 7/2009 | Peckovich | 248/345.1 |
| 2009/0267461 | A1 | | 10/2009 | Salloum et al. | |
| 2010/0090567 | A1 | | 4/2010 | Felice | |
| 2012/0145662 | A1 | | 6/2012 | Geng | |

* cited by examiner

CLADDED FIXTURE

FIELD OF THE INVENTION

This invention pertains to a display fixture. More particularly, the invention pertains to a display fixture system that has decorative features that can easily be changed to reflect different themes or holidays.

Known display racks provide little flexibility in display, design, layout and appearance. In general, display racks are functional, not contributing to the presentation of the product. Because a display rack must present the product through a variety of promotions and seasonal changes, it must necessarily be bland and featureless. Thus, it would be desirable to have more flexibility in designing and arranging such displays to allow for more decorative and/or seasonal motifs to be used.

BACKGROUND OF THE INVENTION

Such systems can be used, for example, for providing a display unit to display art or promotional material. Consumers will likely recognize portable booths or kiosks that can be erected in a free-standing manner in the street or on a sidewalk for such display purposes. Display racks of this nature may be used by artists at art fairs for displaying their work. The racks can also be used for displaying promotional or other advertising media, for example, at trade shows and the like, in addition to clothing and other merchandise at retail stores.

Accordingly, there is a need for a display rack which can easily change its appearance to suit the promotion or the season as desired.

SUMMARY OF INVENTION

A typical display fixture system includes a framework of upper and lower, spaced apart, parallel horizontal brackets for mounting to an associated vertical bracket or riser. Each bracket has a securing location that corresponds to a securing location of the other bracket. The brackets are mounted to each other for a stable fixture.

Support risers extend between and are secured to the horizontal member. The risers secure between the members vertically, transverse to the members. The risers mount to the upper and lower members at securing locations on the members.

The display system is configured to support product display elements, such as shelves, display surfaces, signs and hangers to, for example, hang clothing, as well as other types of display ornamentation. The system is flexible and sufficiently versatile that using standard posts and brackets, custom displays can be designed and installed quickly and efficiently, with a minimum number of fasteners required.

The above described display fixtures system comprises a framework on which the subject invention is secured. Each visible structural member of the framework is covered with a removable cover or cladding in which the vertical members are held in place by the horizontal members. Each vertical and horizontal member is also independently held to the framework by a magnet or other fastener.

Optionally, panels may be secured between the vertical support posts; such panels may be decorated similar to the cladding about to be described. The panels should be easily removable.

In a preferred embodiment each framework member is covered by a cladding member with the vertical members being held in place by the horizontal members. The support framework is generally in the shape of a T, H, S, or I so that the crossbar horizontal member holds the other horizontal or linking member in place. Further, panels may be secured to the framework for additional decoration.

By virtue of being easily removable, each of the vertical and horizontal members may be decorated according to a certain theme or color. When a particular display rack is needed in another part of the retail store or if the theme is changed according to the season, each display rack may undergo a change of decoration through the facile substitution of the brackets' and risers' cladding. Thanksgiving decorations may easily segue into Christmas decorations or a given display rack may be easily transferred from a colorful woman's clothing section to a more subdued men's clothing section.

Other features and advantages of the present invention will be apparent from the following detailed description of the accompanied drawings and the appended claims.

DETAILED DESCRIPTION OF THE PREFERRED EMBODIMENTS

Figure 1:
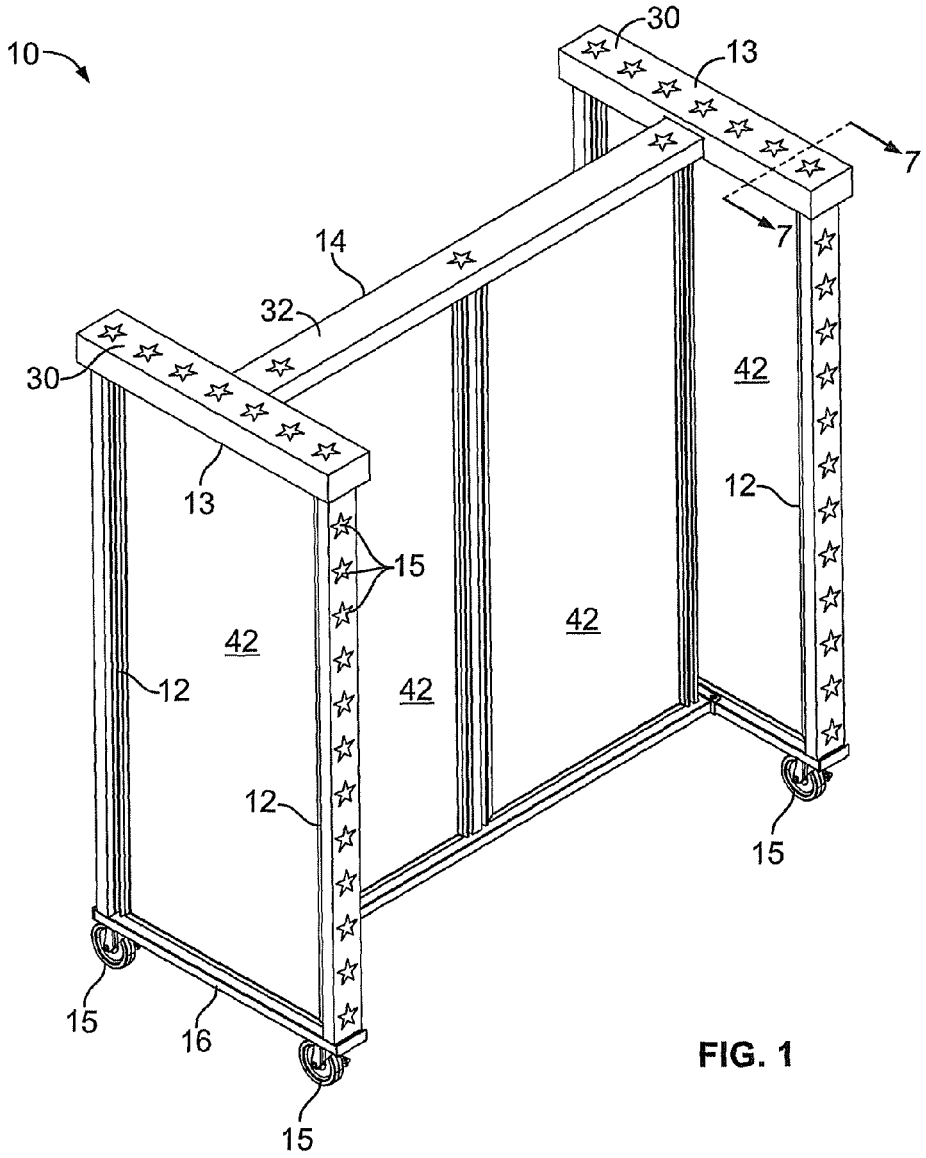
FIG. 1 is a perspective view of a display fixture system embodying the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown a display fixture system 10 embodying the principles of the present invention. This system include a framework of metal, having a plurality of parallel, vertically extending upright support posts 12 secured to upper and lower members 13, 16, respectively and mounted on casters 15. Adjustable feet or other type footing may also be used. The members 13, 16 are adapted to secure the vertical support posts or legs 12 in spaced parallel relation to one another. Members 13, 16 may be secured to vertical support posts or legs 12 by welding or by threaded fasteners, such as screws and wingnuts. It will be appreciated by those skilled in the art that the members 13, 16 can be formed in a wide variety of configurations, which configurations such as straight, curved and bowed are within the scope of the present invention. Further the framework may be in the shape of an H, I or T, with two to four vertical support posts and 2 or 3 horizontal members, as necessary to complete the framework.

A cover, or cladding, is placed over the framework in a removable manner, as will be explained. This cover may be of any suitable material such as wood, metal, plastic or other materials as known in the art. This cover has decorative elements, as in a certain color or design. FIG. 1 shows stars 15 as the decorative element. The decorative element may also reflect seasonal themes, such as Thanksgiving, Christmas or $4^{th}$ of July, as desired. Panels 42 may be secured to the framework to provide more decoration to the display fixture, as needed.

Figure 2:
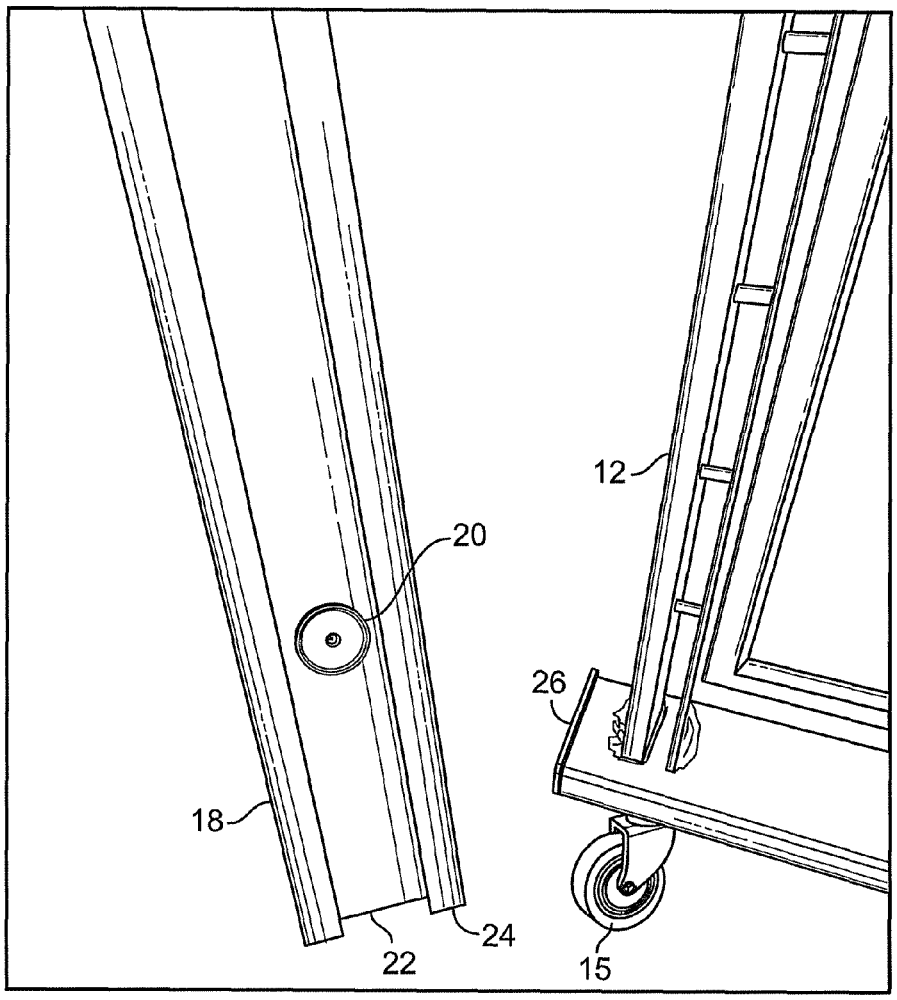
FIGS. 2 and 3 are partially assembled perspective views of one vertical upright support post, illustrated as the vertical cladding member inserts into and secures to the upper and lower members.
Figure 3:
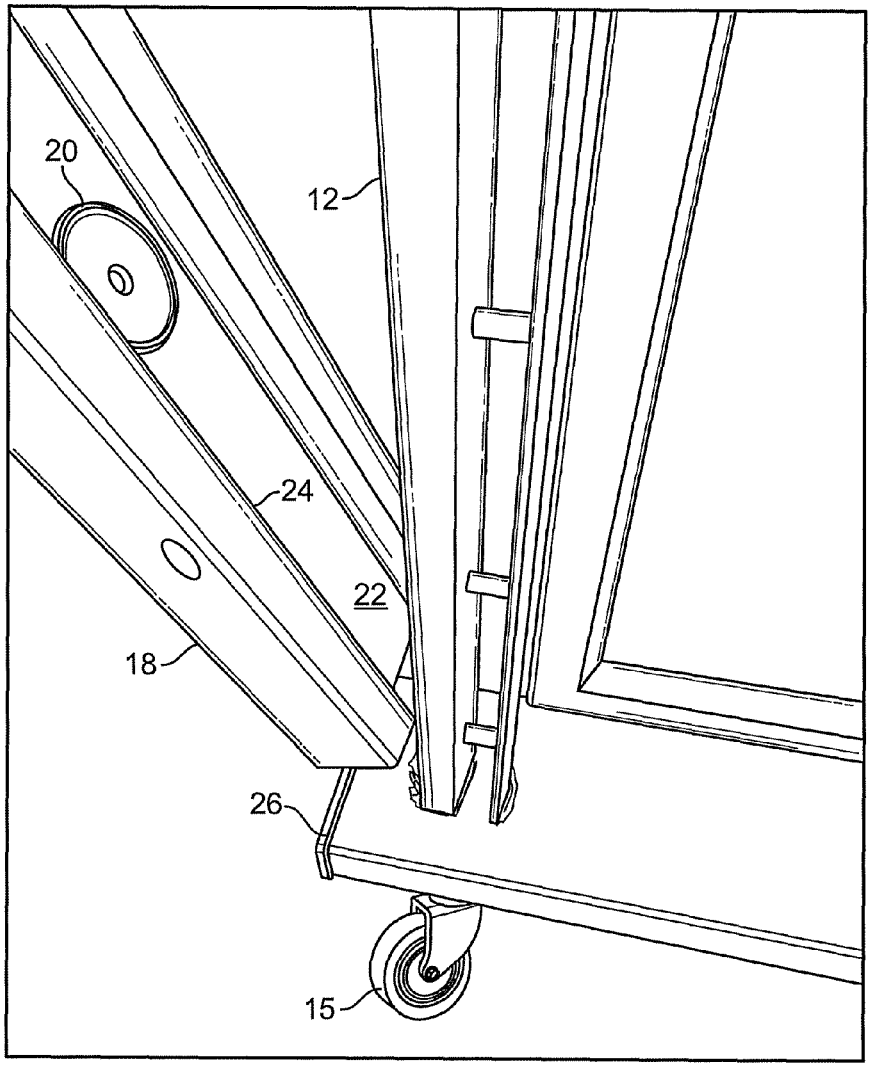

In FIG. 2. is shown a vertical cover element 18, comprising a C-shaped longitudinal element having a flat center 23 with depending sides 24. The center of the longitudinal element may be arched or flat as desired. Thus, when cover element 18 is placed over upright post 12, it will cover the exteriorly presented or visible portions of the post. In one embodiment the flat upper or center 22 has a magnet 20 in its interior. The magnet 20 removeably secures the cover element to the metal support post 12. The bottom or lower member 16 has an upstanding rim or edge 26 at each end (FIG. 3). This edge serves to limit the travel of the bottom of the vertical cover element 18 and lock it in when placed over upright post 12. The cover element is thus secured tightly against the upright post and completely covers the visible portions of the post, being held by the magnet 20 and the edge 26.

Figure 4:
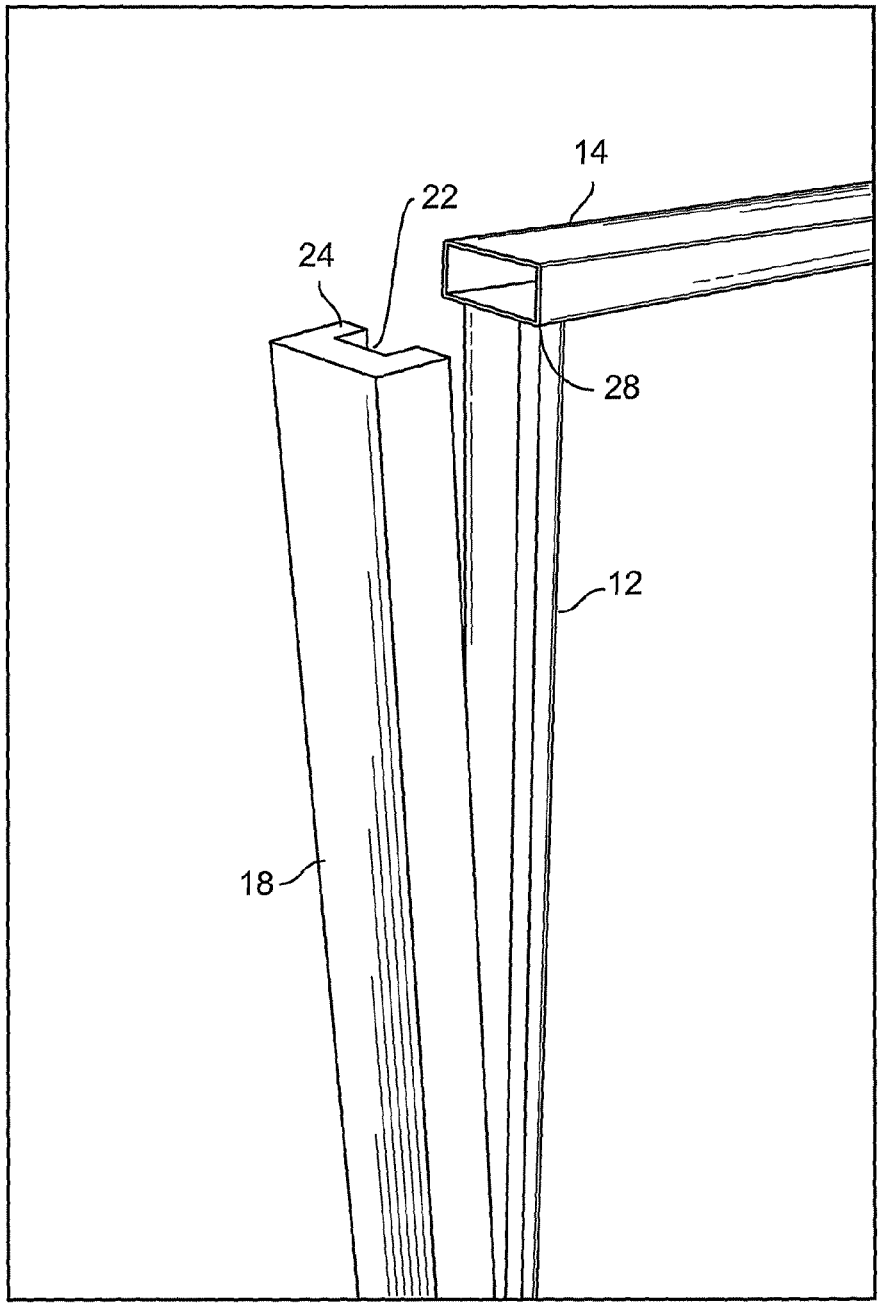
FIG. 4 is a partially assembled perspective view showing the vertical cladding member about to cover the vertical support post under the horizontal upper member.

The top of the upright post and upper portion of the vertical cover element is covered by end horizontal cover member 30, constructed similarly to vertical cover element 18 with an overhang 28 over the upright post and the vertical cover element 12 (FIG. 4) and the length of the overhang 28 is equivalent to the thickness of the flat upper 22. The overhang 28 locks the vertical cover element in place. An identical structure and function is present at the other end of end horizontal member 30 and end horizontal member 13.

Figure 5:
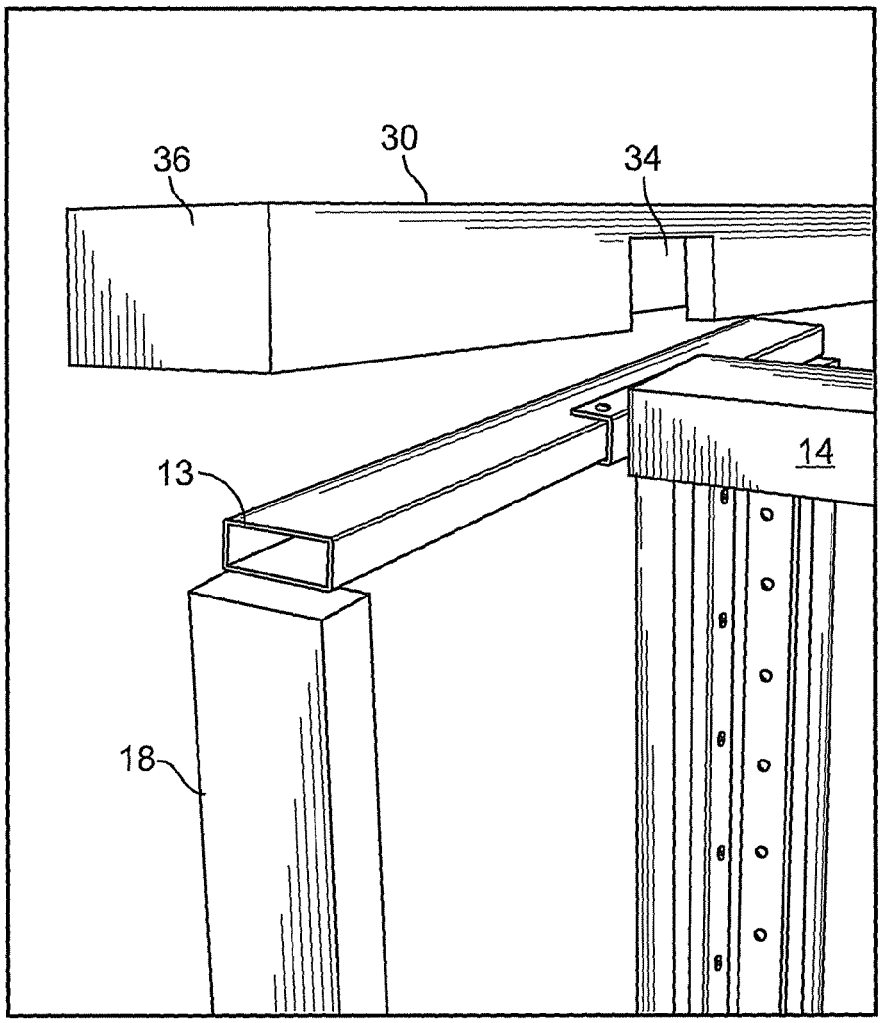
FIG. 5 is a partial perspective view illustrating a horizontal cladding member being mounted to an upper member.
Figure 6:
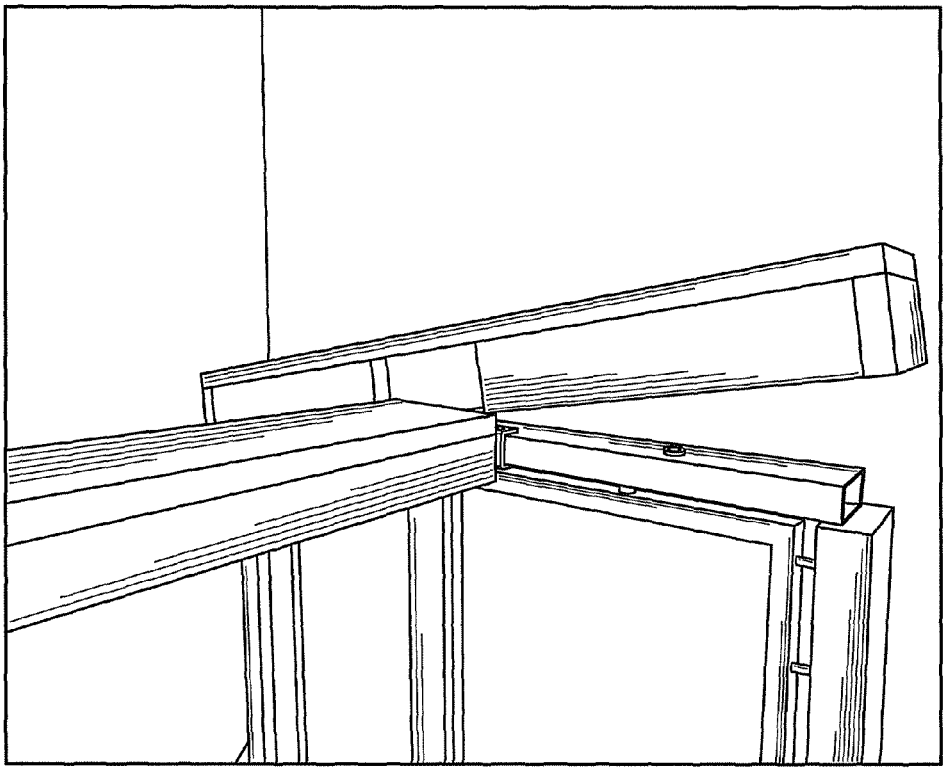
FIG. 6 is a partial perspective view of the display system of the subject invention showing a horizontal cladding member about to cover the horizontal member.
Figure 7:
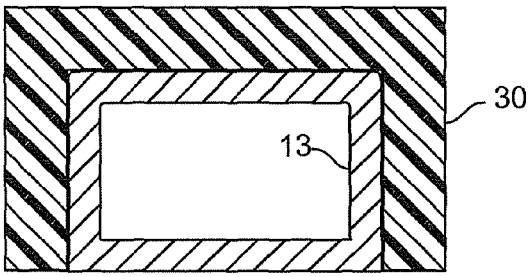
FIG. 7 is a cross-section taken along the lines 7-7 of FIG. 1 embodiment of a vertical sub-port post in accordance with the principles of the present invention.

FIG. 5 shows a horizontal cross bar cover member 32 which fits over horizontal upper cross member 14 and covers it with its decorative motif. End horizontal cover members 30 cover the end horizontal members 13. A notch 34 in the center portion of end horizontal member 30 allows entry by and cover of horizontal crossbar cover member 32 at both ends. In addition, the notch 34 covers and secures the cross bar cover member 32 to the display fixture 10, while a magnet similar to that shown on vertical cover member 18 in FIG. 2, or other fastening means (not shown), secures the end horizontal cover member 30 to the end horizontal member 13. The end horizontal cover member 30 has a longitudinal cross section in the shape of a "C" as shown in FIG. 7, having a upper segment 31 with depending sides 33. The upper segment may be flat or domed as desired. Each end 36 of the end horizontal cover member 30 is closed as shown in FIG. 5, thereby holding vertical cover element 18 securely in place at both ends.

In this manner the vertical cover elements 18 are all held and locked in place at both ends, and the horizontal cross bar 30 is held and locked in place.

In another embodiment, the fasteners holding the respective elements and members may be flat head screws and wingnuts fastening through predrilled openings in the upper and lower members and upright support posts.

The underlying framework (upper and lower members and upright support posts) is preferably of metal for strength and rigidity, it is possible that plastic or wood may be used in these parts.

Figure 8B:
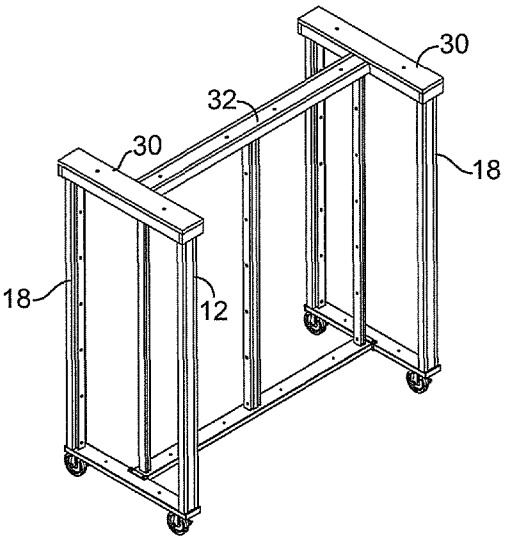
FIG. 8*a*-8*c* are perspective views of an embodiment of the subject invention in progressive stages of assembly.
Figure 8C:
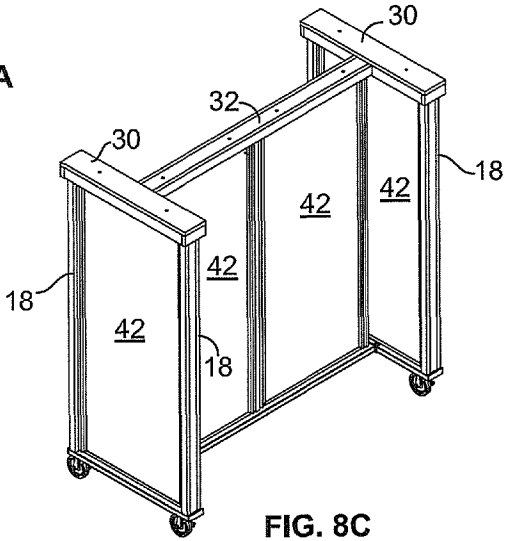
Figure 8A:
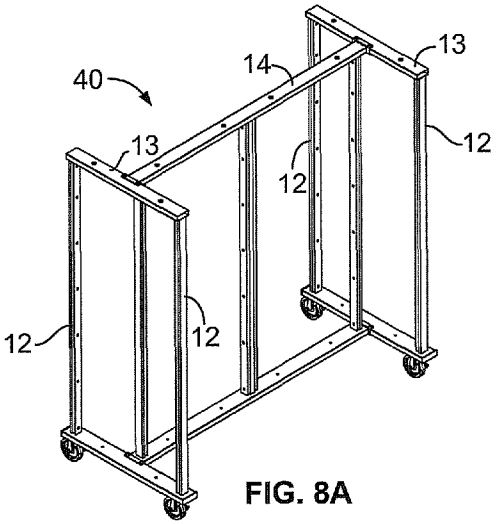
Figure 9:
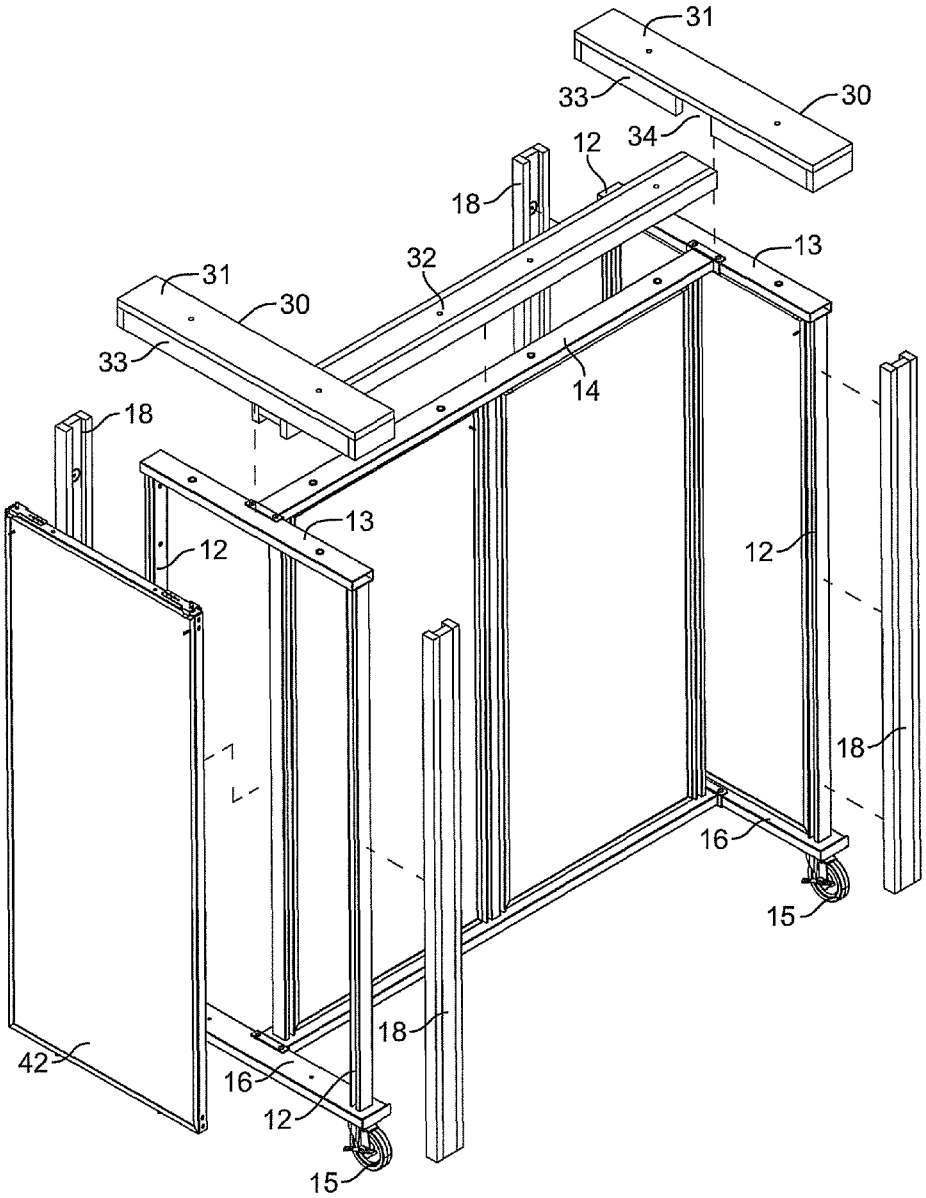
FIG. 9 is an exploded view of one embodiment of the subject invention.

Thus, with the above described structure, a display fixture comprises two major component features: a structural framework and a cover. The cover is designed to easily be placed over the framework 40 and then easily removed as depicted in FIG. 8A-8C. The underlying framework 40 is shown in FIG. 8A. The cover is placed on the framework 40 in the above described sequence, first the vertical cover elements, then the horizontal crossbar, which are all locked in place by the horizontal cover elements as shown in FIG. 8B. Removal for a change in decor is accomplished by removing the cover elements in reverse. The horizontal cover elements are first removed, followed by the horizontal cross-bar cover and then the vertical cover elements. With the cover in place, panels 42 may be inserted as shown in FIG. 8C.

The subject invention may be provided as a kit. Several sets of differently themed or decorated cover members and panels may be provided. For instance, a Christmas themed cover set, a Thanksgiving themed cover set, an Easter themed cover set, a $4^{th}$ of July themed cover set and a plain cover set may be packaged together. A retailer may then easily switch from one to the other depending on the season and the need. Other related themes, such as male/female; infant/preteen/teen; and other decorative themes are contemplated within the scope of this invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A display fixture comprising a structural frame, said structural frame having vertical support posts and horizontal members connecting the vertical support posts; a first set of decorative cover members secured to said structural frame, a second set of decorative cover members, said first set of decorative cover members being removable from said frame for replacement with the second set of decorative cover members, said first set of decorative cover members being different in surface decoration only from said second set of decorative cover members, each of said first and second set of decorative cover members completely covering an outward face of said vertical support posts and horizontal members.

2. The display fixture of claim 1 wherein said first set of decorative cover members include a plurality of c-shaped longitudinal elements for covering a visible portion of said structural frame.

3. The display fixture of claim 1 wherein said decorative cover members include a horizontal cover member for covering an outwardly facing portion of said horizontal members and a vertical cover member for covering an outwardly facing portion of said vertical support posts.

4. The display fixtures of claim 3 wherein one of said horizontal cover members secures a vertical cover member to the frame.

5. The display fixture of claim 3 wherein said horizontal cover member secures a second of said horizontal cover members to the frame.

6. The display fixture of claim 1 wherein said structural frame is metal and a decorative cover member is secured to said structural frame by a magnet.

7. The display fixture of claim 6 wherein said horizontal cover member has a notch in which a second horizontal cover member fits and is secured.

8. The display fixture of claim 1, posts and said horizontal members each being covered by and removably fastened to a vertical decorative cover member and a horizontal decorative cover member respectively.

9. The display fixture of claim 8 comprising four vertical support posts and three horizontal frame members to form an H or an I structure when viewed from above.

10. The display fixture of claim 9 wherein the three horizontal frame members comprise a cross bar and two end bars, said two end bars each having an end cover that further secures a cross bar cover.

11. The display fixture of claim 8 wherein said vertical and horizontal decorative cover elements are removably secured to said vertical support post and said horizontal frame member by magnets.

12. The display fixture of claim 8 comprising three vertical support posts and two horizontal frame members to form an T structure when viewed from above.

13. The display leg fixture of claim 12 wherein there are two horizontal decorative cover elements, comprising a cover member and a cross bar cover member and the cross bar cover member secures the vertical cover members.

14. The display fixture of claim 8 further including at least two vertical support posts and a panel between the two vertical support posts.

* * * * *